US006098963A

United States Patent [19]

Dubin et al.

[11] Patent Number: 6,098,963

[45] Date of Patent: Aug. 8, 2000

[54] FILL-IN-PLACE HUMIDIFIER

[75] Inventors: Melvin Dubin, Great Neck; Karl Bachert, Roslyn Heights; Donald Brown, Sea Cliff, all of N.Y.

[73] Assignee: Slant/Fin Corporation, Greenvale, N.Y.

[21] Appl. No.: 09/206,901

[22] Filed: Dec. 7, 1998

[51] Int. Cl.[7] ..... B01F 3/04

[52] U.S. Cl. ..... 261/66; 261/72.1; 261/107; 261/DIG. 65

[58] Field of Search ..... 261/66, 72.1, 104, 261/107, DIG. 65; 220/252

[56] References Cited

U.S. PATENT DOCUMENTS

| | | | |
|---|---|---|---|
| 1,152,178 | 8/1915 | Hillyard . | |
| 1,799,764 | 4/1931 | Schellberg . | |
| 2,042,455 | 6/1936 | Barrott . | |
| 2,535,516 | 12/1950 | Resek . | |
| 4,261,353 | 4/1981 | Bartels | 261/DIG. 65 |
| 4,631,152 | 12/1986 | Uchida . | |
| 4,663,091 | 5/1987 | Seo . | |
| 5,061,405 | 10/1991 | Stanek . | |
| 5,480,588 | 1/1996 | Tomasiak . | |
| 5,682,932 | 11/1997 | Ediger . | |

FOREIGN PATENT DOCUMENTS

| | | | |
|---|---|---|---|
| 3503699 | 8/1986 | Germany | 261/72.1 |
| 58-127031 | 7/1983 | Japan | 261/72.1 |

*Primary Examiner*—David A. Simmons
*Assistant Examiner*—Robert A. Hopkins
*Attorney, Agent, or Firm*—Herbert Dubno

[57] ABSTRACT

A fill-in-place humidifier in which the tank can be rotated 180° between a filling position and an operating position. In the filling position a cap can be removed from the tank for filling and can be replaced when filling is complete, the cap bearing a valve which automatically opens when the tank is rotated into its operative position.

12 Claims, 7 Drawing Sheets

FILL-IN-PLACE HUMIDIFIER

FIELD OF THE INVENTION

The present invention relates to a fill-in-place humidifier and, more particularly, to a humidifier having a rotary drum or tank which, when filled in an upper position, can be rotated into a lower position.

BACKGROUND OF THE INVENTION

One of the problems arising with prior art humidifiers is the requirement that the tank be refilled at a sink which is often not able to accommodate the large size of the tank so that the latter can only be partially filled when placed under a spout. Many systems have been provided in attempts to overcome the problem, including placing of openings at the side of the tank (see U.S. Pat. No. 5,480,588), or providing tanks which are of low height (see U.S. Pat. No. 4,663,091) or tanks which are even formed with funnel shapes to facilitate filling (see U.S. Pat. No. 5,682,932).

The tanks can be inverted for filling as has been noted (U.S. Pat. No. 5,061,405) and the filling can be effected by a pitcher, hose or some other more portable vessel. The act of turning the fill tank over may pose a problem for some individuals and once the tank is turned upside down, may be unstable.

Mention may be made of systems in which containers have been rotated from one position to another in place on a unit utilizing them and these systems have either applied the technique to upright containers (U.S. Pat. Nos. 1,799,764 and 4,631,152) or to drum type liquid dispensers (U.S. Pat. Nos. 1,152,178 and 2,042,455) which have not been amenable to use in humidifier systems.

OBJECTS OF THE INVENTION

It is the principal object of the present invention to provide a humidifier which is more easily refillable than conventional humidifiers and which avoids drawbacks of earlier humidifiers.

It is another object of the invention to provide a compact, easily operated and aesthetically pleasing humidifier unit which has significant advantages over prior art systems.

Yet another object of the invention is to provide a fill-in-place humidifier wherein the tank nevertheless can be readily removed if desired.

SUMMARY OF THE INVENTION

These objects and others which will become apparent hereinafter are attained, in accordance with the invention in a humidifier, which utilizes a tank having a generally horizontal axis and which is rotatable on the humidifier base between a position in which an opening on the tank is disposed at an upper position so that the tank can be refilled in place on the base by a pitcher or the like, but which can be rotated to position the outlet in connection with a chamber in the base connected to the vapor or mist generating unit. Thus the new humidifier structure of the invention provides for the humidifier tank to be filled while it is still on the humidifier base. The tank is normally not removed from the humidifier base for refilling.

The tank is preferably constructed so it can rotate 180° in place. When a refill is needed the tank is rotated 180° to position the fill cap in the upper "refilling" position. The cap can be removed and pitchers full of water can be poured into the opening thus uncovered. When the refilling is completed the cap is replaced and the tank is rotated 180° so that the water supply valve on the cap, i.e. a self-closing valve, is in a downward position. The water supply valve is automatically opened in this position to allow the flow of water to the vapor or mist generating unit. When the tank is rotated from this position the valve automatically closes to prevent accidental discharge of water.

More particularly, the humidifier according to the invention can comprise:

- a water-dispersing unit on the base for generating a water vapor or mist;
- a water-receiving chamber in the base opening upwardly at a location spaced from the unit and communicating with the unit; and
- a tank having a generally horizontal axis mounted above the chamber on the base and having an opening rotatable between an upper position in which the tank is refillable and a lower position wherein the opening communicates with the chamber to supply water to the unit.

The tank has at least a portion of a wall which is cylindrical and centered on this axis and can have downwardly diverging sides extending from the cylindrical wall so that the bottom of the tank has a rectangular plan configuration. The tank is received between a pair of uprights on the base which form journals for opposite ends of the tank, thereby enabling the tank to rotate about the axis.

Advantageously, the tank has pins at the opposite ends thereof and the uprights have upwardly extending grooves receiving the pins, thereby enabling the tank to be lifted off the base. Seats at the bottoms of the grooves can receive the pins and form the aforementioned journals therefore. The unit generating water vapor or a mist can be a heater which evaporates the water and produces steam, or an ultrasonic generator which atomizes the water, or any other appropriate unit for dispersing the water or creating a flow of water vapor. The mist or steam can be discharged by a tower or column also provided on the base and communicating with the aforementioned unit. If desired, a fan or blower can be provided to displace air through the tower and thereby entrain the mist or water vapor out of the tower. The tower can be removably fitted on the base as well and, if desired, can be shaped to lock a respective pin of the tank in place. It has been found to be advantageous, moreover, to provide at least one of the journals for the tank with a braking means for slowing the rotation of the tank into its lower position. If desired the tank can have a handle to facilitate the carrying thereof.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
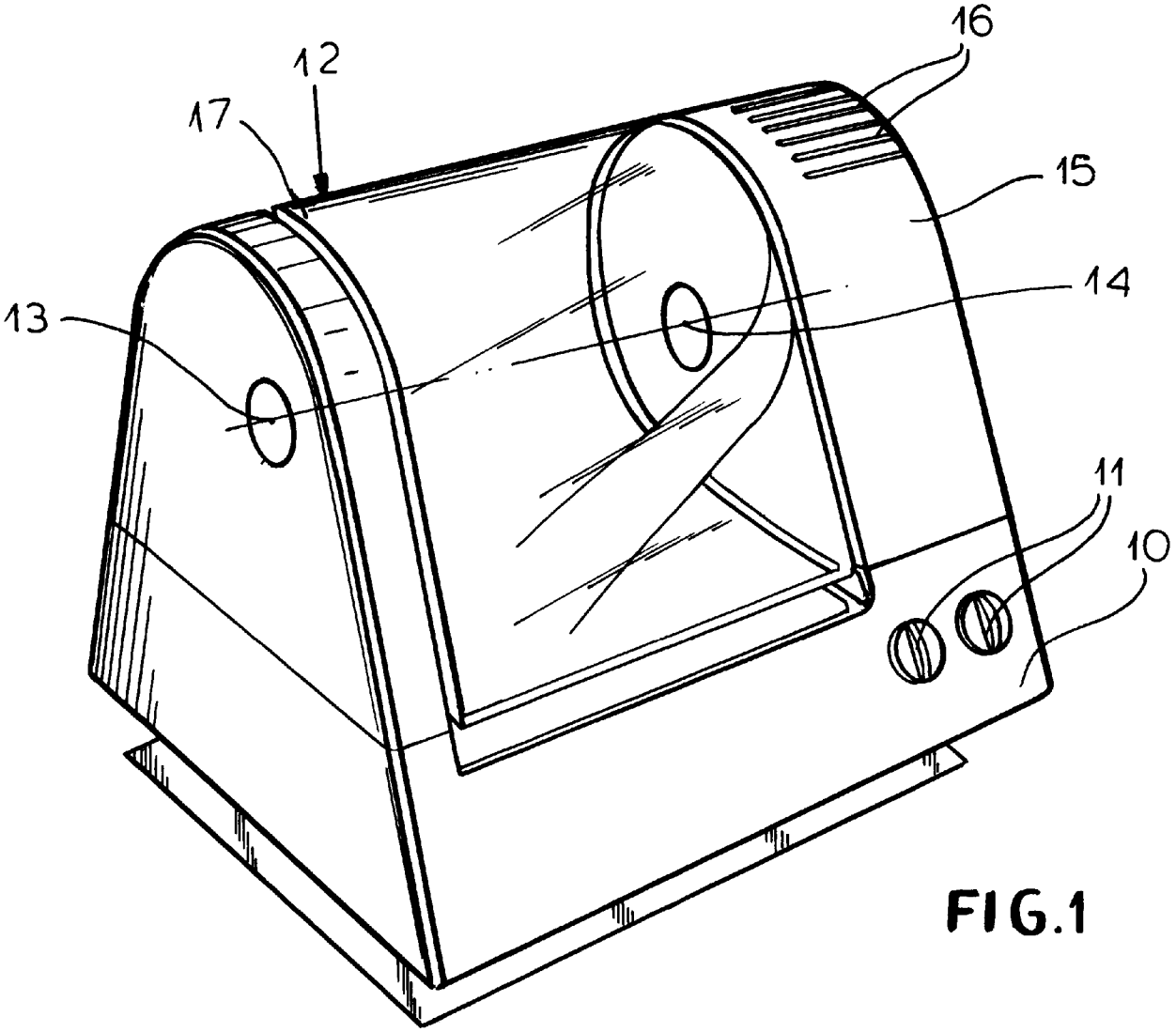
FIG. 1 is a perspective view of a humidifier, according to the invention, illustrating the water tank or drum in its position of use.

From FIG. 1 it will be apparent that a humidifier according to the invention can comprise a base 10 with the usual controls 11 and on which is mounted a tank 12 having pivots 13 and 14 defining a substantially horizontal axis of rotation for the tank 12. Above the heating unit which generates steam, there is provided a column 15 which has vents 16 from which the vapor emerges. The column or tower 15 can be removable from the base.

The tank 12 is also removable as will be described in greater detail below. The tank 12 comprises a cylindrical wall segment 17 extending over at least 180° and can have a planar wall segment 18 extending to the base 19 of the tank which has generally a rectangular configuration. If desired, the tank can be formed with a recess 20 provided with a handle 21, enabling the tank to be lifted from the base.

The tank 12 has a filling opening 22 provided with a removable cap 23, preferably threaded onto the rim of the opening and formed with a self-closing valve 24 which has a valve plate 25 carried by a stem 26 and biased by a spring 27 into the closed position. When the stem or plunger 26 is pressed inwardly, the valve is opened. As has been shown in FIG. 3, the base 110 with its controls 111 can have a pair of uprights 130 and 131 with grooves 132, 133 adapted to receive pins 134 and 135 projecting from opposite ends of the tank 112. The latter has a threaded cap 123 which can be removed for filling.

Figure 3:
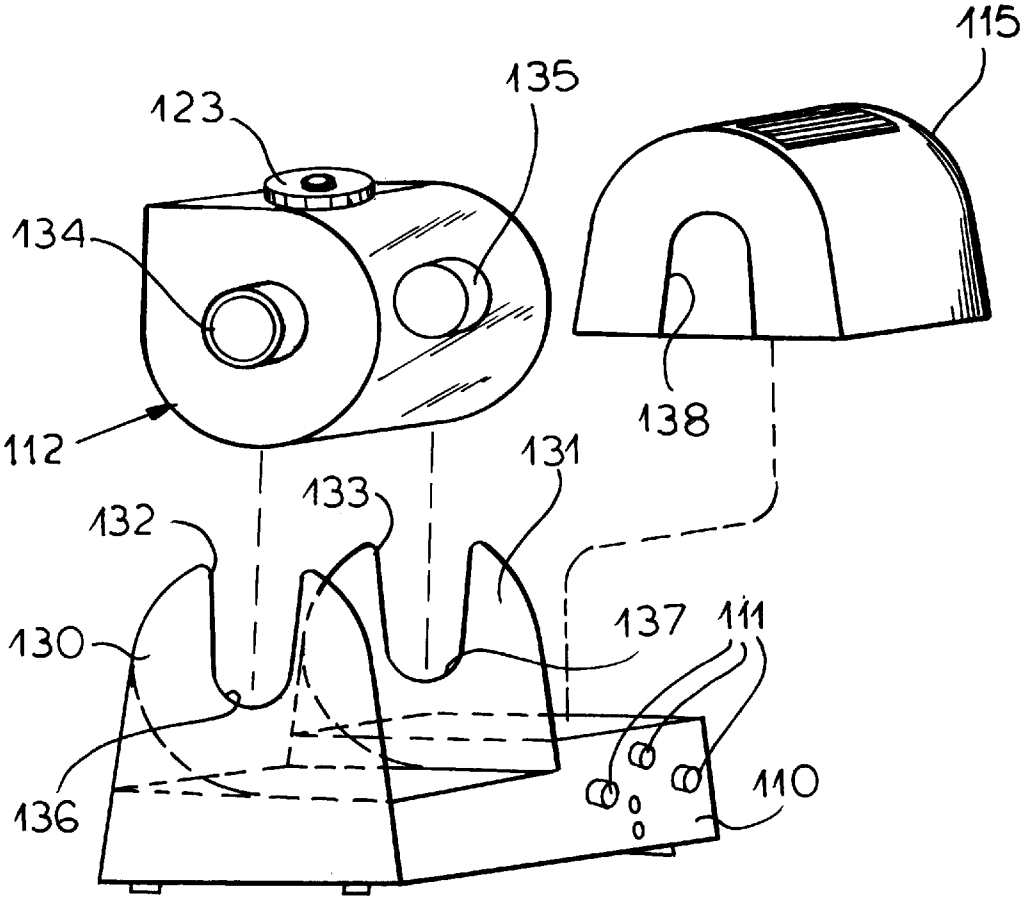
FIG. 3 is an exploded highly diagrammatic perspective view showing important elements of a humidifier according to the invention.

The grooves 132, 133 terminate in seats 136 and 137 in which the pins 134 and 135 can rest. A removable steam tower 115 can have a groove or slot 138 which can fit over the pin 135 to lock the tank 112 in place. Normally the tank remains in place and is only rotated through 180° for filling but, as shown in FIG. 3, it can be removed upon removal of the steam tower 115.

Figure 4:
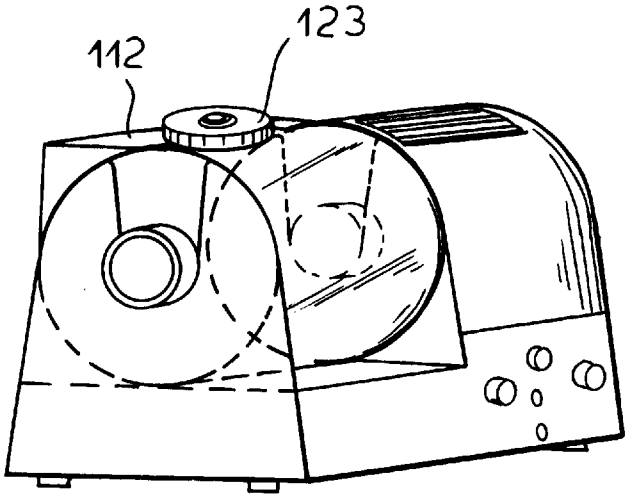
FIG. 4 is a perspective view with the tank or drum rotating into its filling position.
Figure 5:
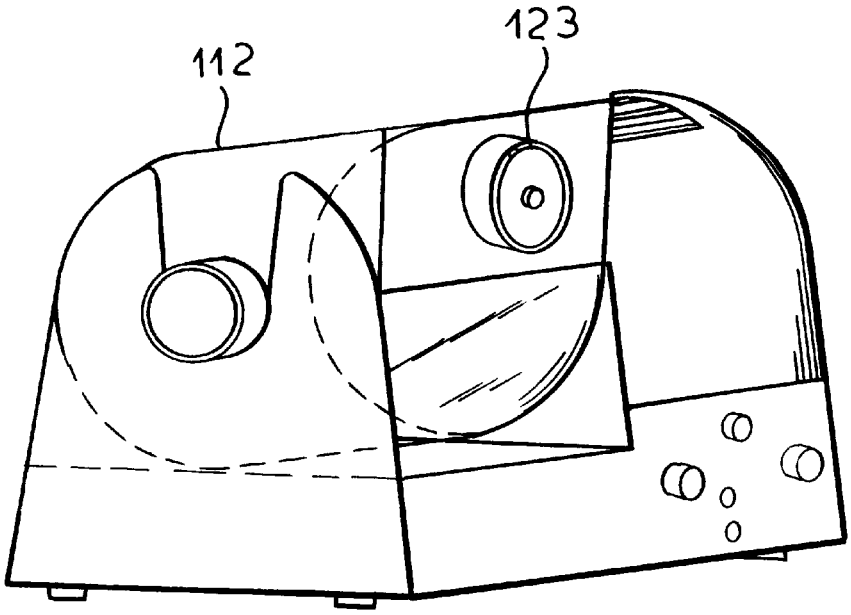
FIG. 5 is a view similar to FIG. 4 with the tank rotated halfway toward the operating position.
Figure 6:
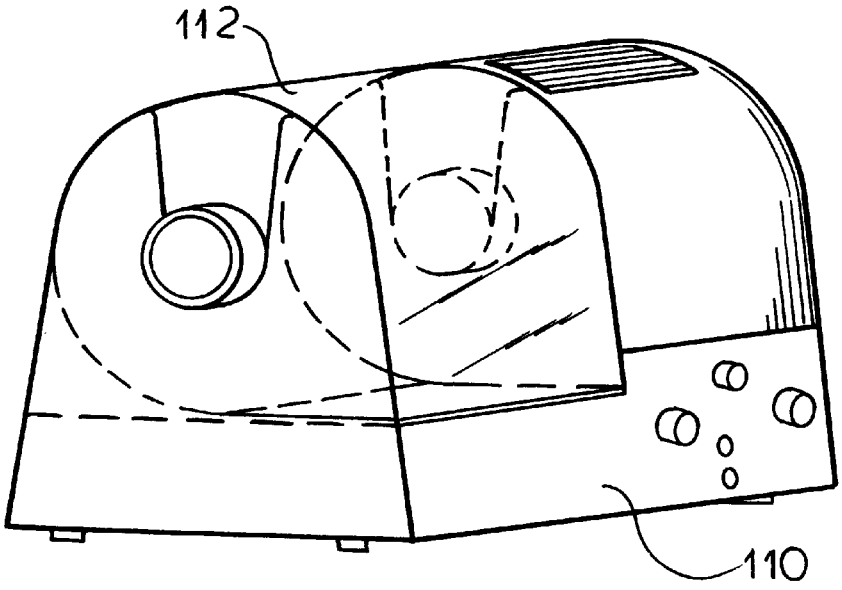
FIG. 6 is another view similar to FIG. 4 showing the operating position.
Figure 7:
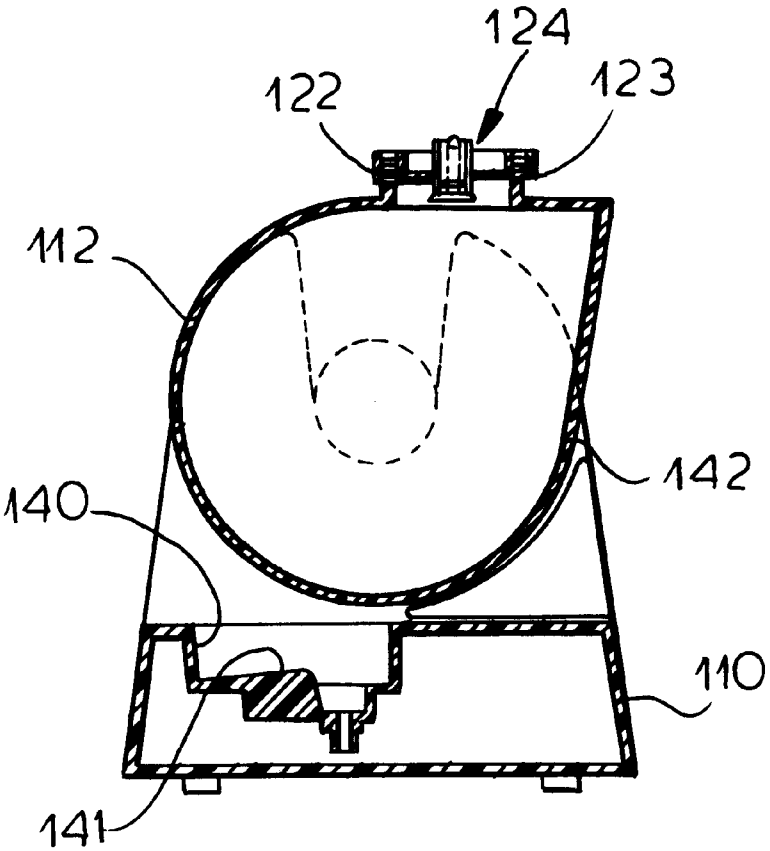
FIG. 7 is a cross sectional view through a humidifier according to the invention with the tank in its filling position before the cap is removed.

In the assembled position of the humidifier shown in FIG. 4, the tank 112 has its opening in the upper position in which the cap 123 can be removed and the tank filled with water from a pitcher. Once the cap is replaced, the tank 112 can be rotated around the horizontal axis previously described until the opening with the cap 123 is brought into its lower position. A half rotated position has been shown in FIG. 5. When the opening is rotated into its lower position (FIG. 6) the tank 112 is in its operating position on the base 110. This can be better understood from FIGS. 7 and 8. In FIG. 7, the tank 112 has its opening 122 in the upper position and the valve 124 in the cap 123 is shown to be closed. It is assumed that the tank has just been filled.

Figure 8:
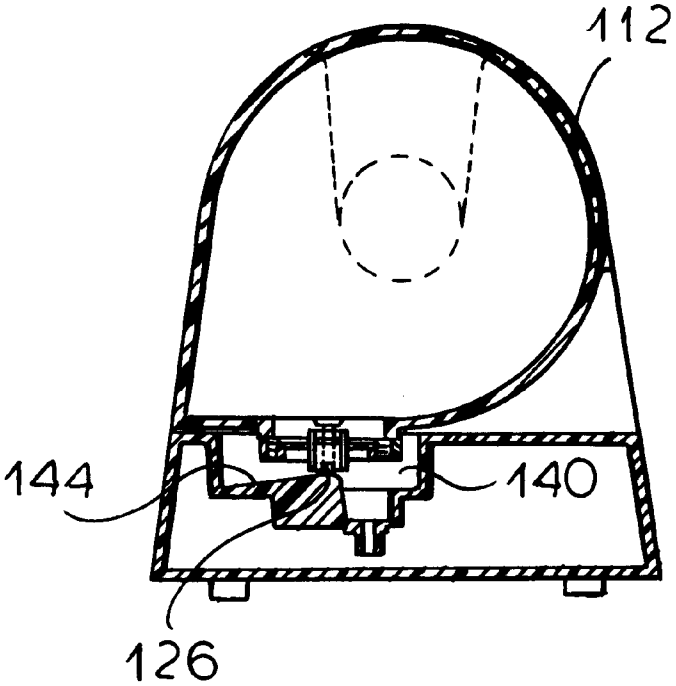
FIG. 8 is a cross sectional view through the humidifier showing the tank in the operating position.

The base 110 has a water receiving chamber 140 which is formed with a ramp 141 engageable with valve pin or stem 126 as shown in FIG. 8. In its filling position, rotation of the tank is prevented by a stop 142 on one or both of the uprights 130, 131. As the tank 112 is rotated into its operating position (FIG. 8) the ramp 144 presses the stem 126 inwardly to allow water to flow into the reservoir 140. The reservoir 140 is connected via a duct 143 with a heating unit 144 located below the steam tower 115 which can include an inner column 145 communicating between the heating unit and the vents 166 directing the steam produced by the heater upwardly. Along the path of the water between the chamber 140 and the heating unit 146 is an ultraviolet lamp 145 (sterilizer) which subjects the water passing through the UV-transparent duct 143 to sterilizing radiation.

Figure 10:
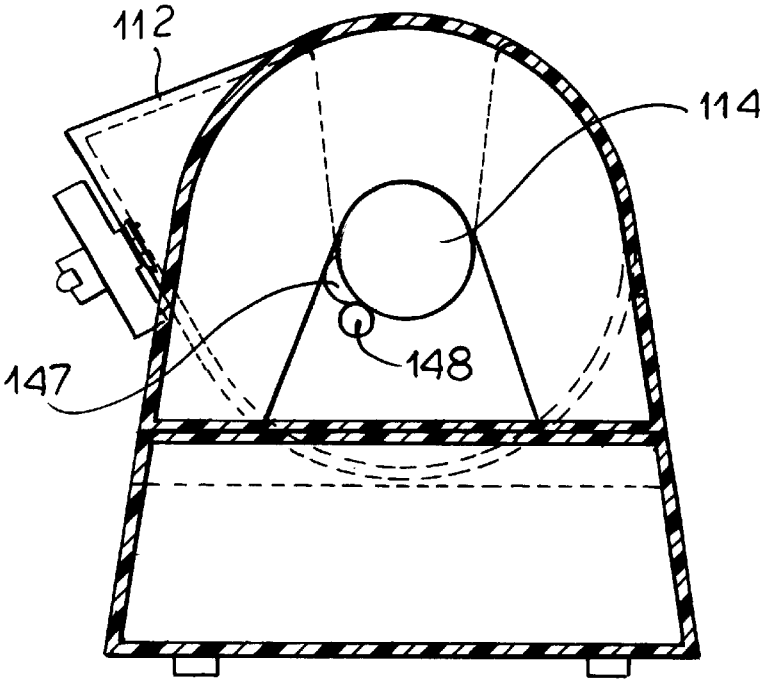
FIG. 10 is diagrammatic section showing the brake arrangement and taken along the line X—X of FIG. 9.
Figure 9:
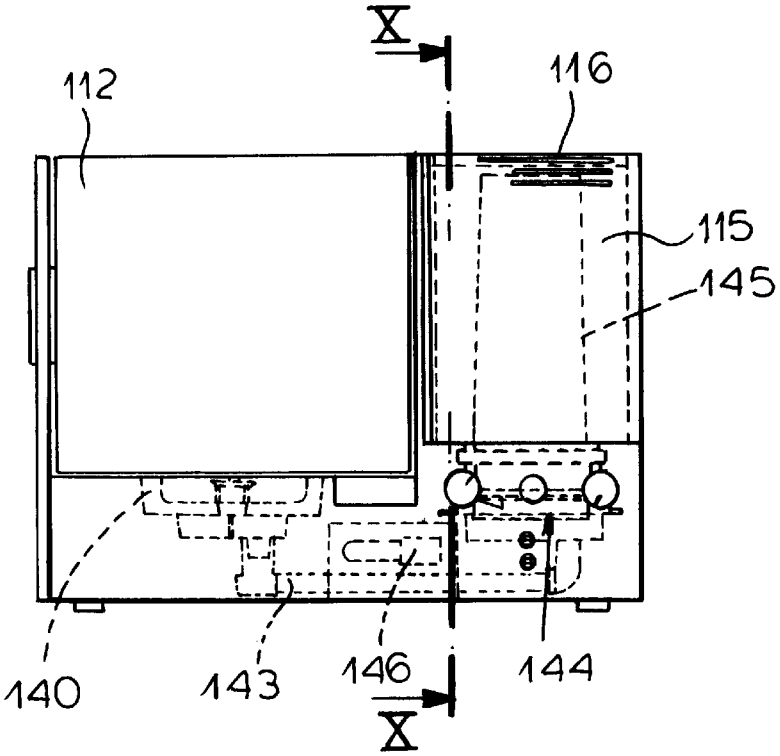
FIG. 9 is a schematic elevational view illustrating other features of the humidifier.

As can be seen from FIG. 10, adjacent one of the pins, e.g. the pin 114 of the tank 112, a cam lobe 147 can be provided for engagement by a bumper 148 to slow the rotation of the tank 112 when it is filled with water and is about to be rotated back into its operative position. The bumper 148 can be on one of the uprights.

Figure 11:
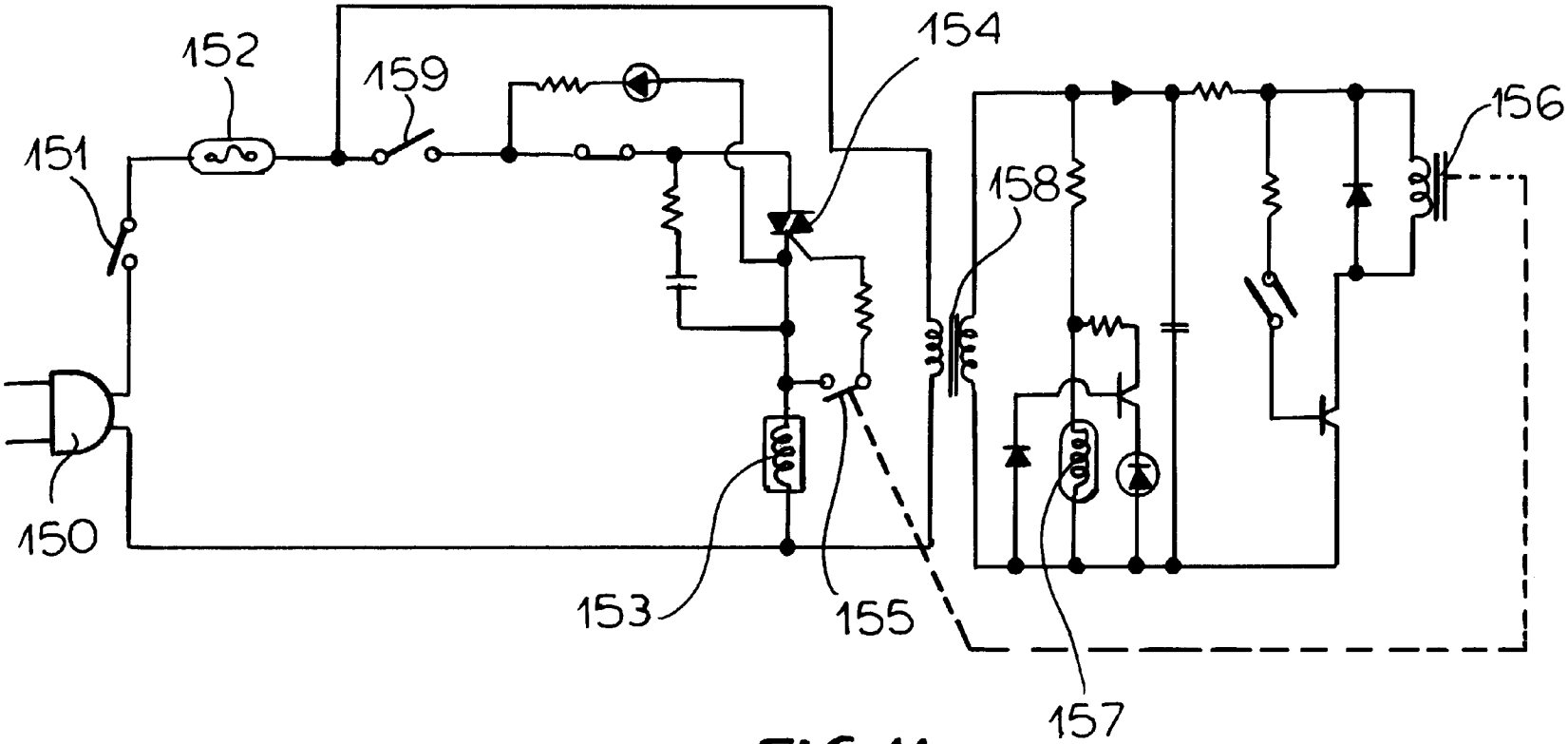
FIG. 11 is a circuit diagram of the apparatus.

The electric power is supplied via the usual plug 150 (FIG. 11) and via an on/off switch 151 through a fuse 152 to a heater 1153 of the heating unit through a triac 154 whose control circuit includes a switch 155 of a relay 156. The ultraviolet lamp is represented at 157 and the supply therefore can include a transformer 158. A further switch 159 can cut off power to the triac 154 and the heater 153.

Other circuit elements are provided as time constant networks, power supply and control components which are not material to the present invention.

Figure 2:
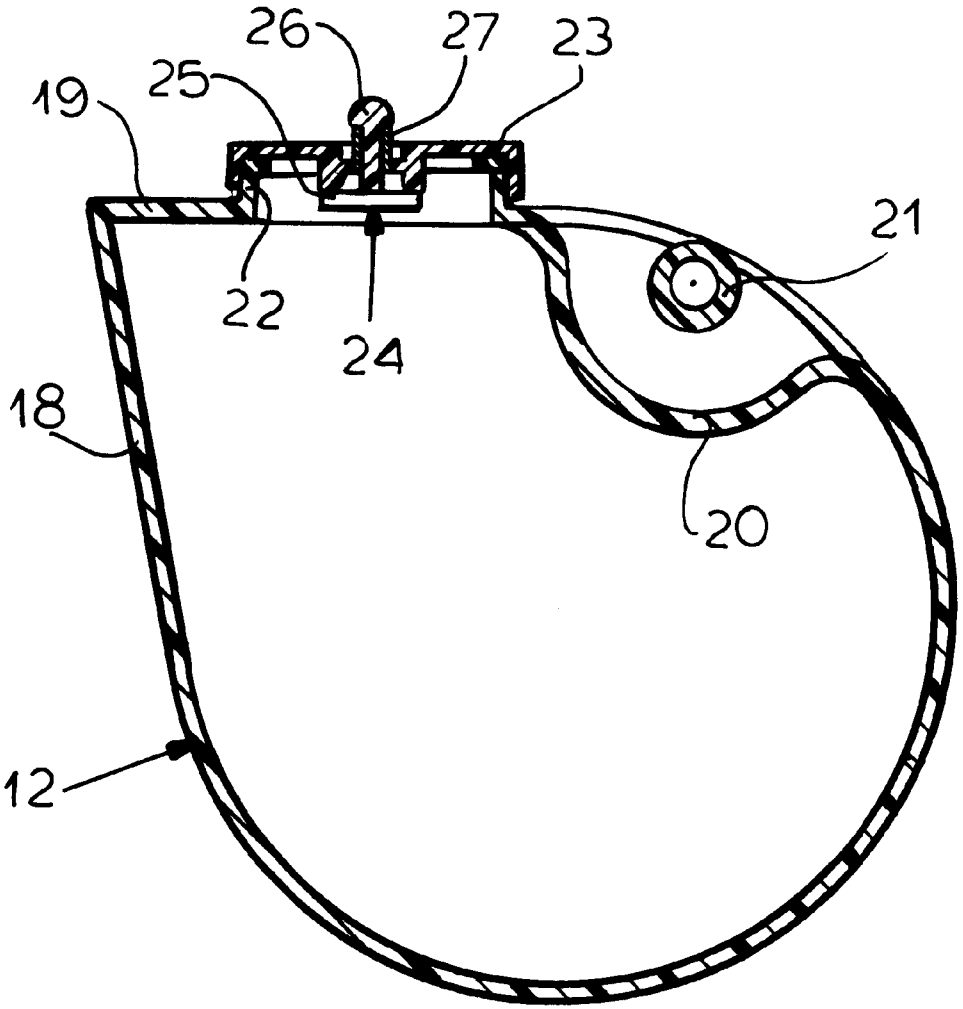
FIG. 2 is a cross sectional view through the tank or drum shown in its position wherein its filling opening is turned upwardly.

In operation, the humidifier functions normally as long as water is present in the tank. Should the water to the tank be fully utilized, refilling is necessary and for that purpose the tank is rotated into the position shown in FIGS. 2 and 4, the cap is removed and the tank filled with water. The cap is then replaced and as the tank is rotated into the operative position, the valve stem is pressed inwardly to allow water to pass from the tank to the chamber and through the duct in which it is irradiated with ultra-violet light, to the heating unit or mist generator.

With the system of the invention it is not necessary to remove the tank, although the tank can be removable, and one need only fill the tank with a pitcher or the like.

I claim:

1. A humidifier comprising:

a base;

a water-dispersing unit on said base for generating a water vapor or mist;

a water-receiving chamber in said base opening upwardly at a location spaced from said unit and communicating with said unit; and a tank having a generally horizontal axis mounted above said chamber on said base and having an opening rotatable between an upper position in which said tank is refillable and a lower position wherein said opening communicates with said chamber to supply water to said unit.

2. The humidifier defined in claim 1 wherein said tank has at least a portion of a wall which is cylindrical and is centered on said axis.

3. The humidifier defined in claim 2 wherein said base is provided with a pair of uprights receiving said tank between them and forming journals for opposite ends of said tank, thereby enabling said tank to rotate about said axis.

4. The humidifier defined in claim 3 wherein said tank has pins at said opposite ends and said uprights have upwardly extending grooves receiving said pins, thereby enabling said tank to be lifted off said base, and seats at bottoms of said grooves receiving said pins.

5. The humidifier defined in claim 1 wherein said opening is provided with a self-closing valve, opening automatically upon rotation of said opening into said lower position.

6. The humidifier defined in claim 5 wherein said valve is provided on a removable cap affixed to said tank at said opening.

7. The humidifier defined in claim 1 wherein said unit is a heater evaporating water.

8. The humidifier defined in claim 1 wherein said unit is an ultrasonic mist generator.

9. The humidifier defined in claim 1, further comprising a removable tower on said base located above said unit for dispensing water vapor or mist produced by said unit.

10. The humidifier defined in claim 1, further comprising brake means for slowing rotation of said tank on said base as said opening approaches said lower position.

11. The humidifier defined in claim 10 wherein said brake means includes a cam on said tank and a bumper on said base engaging said cam.

12. The humidifier defined in claim 1, further comprising a sterilizer between said chamber and said unit for sterilizing water supplied to said unit.

* * * * *